United States Patent [19]

Acerbis

[11] Patent Number: 5,033,580

[45] Date of Patent: Jul. 23, 1991

[54] ABSORPTION SILENCER FOR INTERNAL-COMBUSTION ENGINES, ESPECIALLY FOR OFF-ROAD VEHICLES

[76] Inventor: Franco Acerbis, Acerbis Plastica Italia s.p.a., Via Volta 5, 24021 Albino (BG), Italy

[21] Appl. No.: 505,909

[22] Filed: Apr. 5, 1990

[30] Foreign Application Priority Data

Jul. 4, 1989 [IT] Italy ..... 9395 A/89

[51] Int. Cl.[5] ..... F01N 1/10

[52] U.S. Cl. ..... 181/252

[58] Field of Search ..... 181/247-252, 181/256

[56] References Cited

U.S. PATENT DOCUMENTS 2,101,460 12/1937 Schmidt ..... 181/252
3,159,237 12/1964 Thomas ..... 181/252
3,181,646 5/1965 Edwards ..... 181/248
3,884,037 5/1975 Barber et al. ..... 181/252 X
4,084,650 1/1977 Gardell et al. ..... 181/282

*Primary Examiner*—Brian W. Brown
*Attorney, Agent, or Firm*—McGlew and Tuttle

[57] ABSTRACT

In order to reduce the noise the exhaust of an internal-combustion engine, especially for off-road vehicles, there is utilized an absorption silencer comprising: a housing (1) made up of a plurality of mountable elements (10, 18), built from heat-resisting material and intended to be fitted and fixed in a removable way on the perforated exhaust pipe (50). Stuffing material (13) of deadening and heat-resisting material is interposed using two annular joints, a front one (20) and a rear one (21) built from partially elastic and highly heat-resisting material such as silicone or viton, and which also ensure the housing seal to the exhaust gases.

Advantageously, said the housing (1) is built from heat-resisting material, such as nylon or PPS, according to the rotary molding process.

8 Claims, 1 Drawing Sheet

ABSORPTION SILENCER FOR INTERNAL-COMBUSTION ENGINES, ESPECIALLY FOR OFF-ROAD VEHICLES

FIELD OF THE INVENTION

The present invention refers to an improved absorption silencer for internal-combustion engines, especially for off-road vehicles.

BACKGROUND OF THE INVENTION

It is known that the exhaust systems for motor vehicles are essentially made up of an exhaust pipe and of a silencer, also called "muffler", which is mainly intended to reduce the exhaust noise down to a legally set limit. To this end, the shapes and dimensions both of the exhaust pipe and the silencer are decisive factors. However, these dimensions and shapes affect negatively and heavily the performance of the engine itself by preventing the free flow of output exhaust gases especially in two-stroke engines, as mostly used in off-road vehicles.

The currently known silencers are made up of a metal housing which delimits the expansion chamber of substantially cylindrical shape and has a diameter greater than that of the exhaust pipe but with limited overall dimensions. These may be of two types: the first one, operating by "resonance or reflection", comprises more chambers fitted in series and in parallel to the outlet pipe of the gases which acoustically filter the more relevant portions of exhaust noise; and the second one, operating by "absorption", comprises a deadening material such as rock wool, placed between the pierced exhaust pipe and the housing, which dissipates the exhaust gases energy into heat by its vibration.

Such currently known silencers share the characteristic of having the housing built from metal in one or more parts fixed to each other and to the exhaust pipe by welds and this causes a string of non-negligible drawbacks; in fact, owing to the high performance required to the engine, the stresses imposed to the exhaust system are heavy and the direct transmission of heat and vibrations to the silencer cause a thermal loss, fast wear and favor the breaking of the housing at the weld points. Whenever a component breaks, it is necessary to replace the whole exhaust system and this implies a relevant expanse. In addition to this, laws which limit the noise produced by the exhaust gases in motor vehicles, especially in off-road vehicles, make these silencer arrangements unsuitable to meet technical as well as economical requirements.

SUMMARY AND OBJECT OF THE INVENTION

The present invention has the object to eliminate the above mentioned shortcomings by providing a silencer of absorption type which allows a reduction of both the exhaust noise and thermal losses, an increase of its service life and the possibility to replace only the housing in case of failure.

This result has been achieved according to the invention by providing an absorption silencer comprising a housing made up of more mountable elements, which is fitted and fixed in a removable way on the perforated gas exhaust metal pipe by means of two annular joints of heat-resisting and partially elastic material and with the interposition of a deadening and heat-resisting material such as rock wool.

Advantageously, the housing is made of artificial heat-resisting material such as nylon or PPS and the annular joints are built from silicone or viton.

The solution proposed by the present invention allows a silencer to be built which knocks down the exhaust noise by about 4–5 dBA, reduces dispersion of heat to the outside, and lowers significantly the vibrations from the housing, the latter being advantageously made by rotary molding and thus without welds and further able to be assembled on the perforated exhaust pipe in a removable way so as to be easily and quickly replaced with no need to disassembling and replacing the exhaust pipe.

BRIEF DESCRIPTION OF THE DRAWINGS

These and further advantages and characteristics of the invention will be more and better understood by any person skilled in the art by the following description in conjunction with the attached drawing given as a practical exemplification of the invention, but not to be considered in a limiting sense; in which.

DETAILED DESCRIPTION

Figure 1:
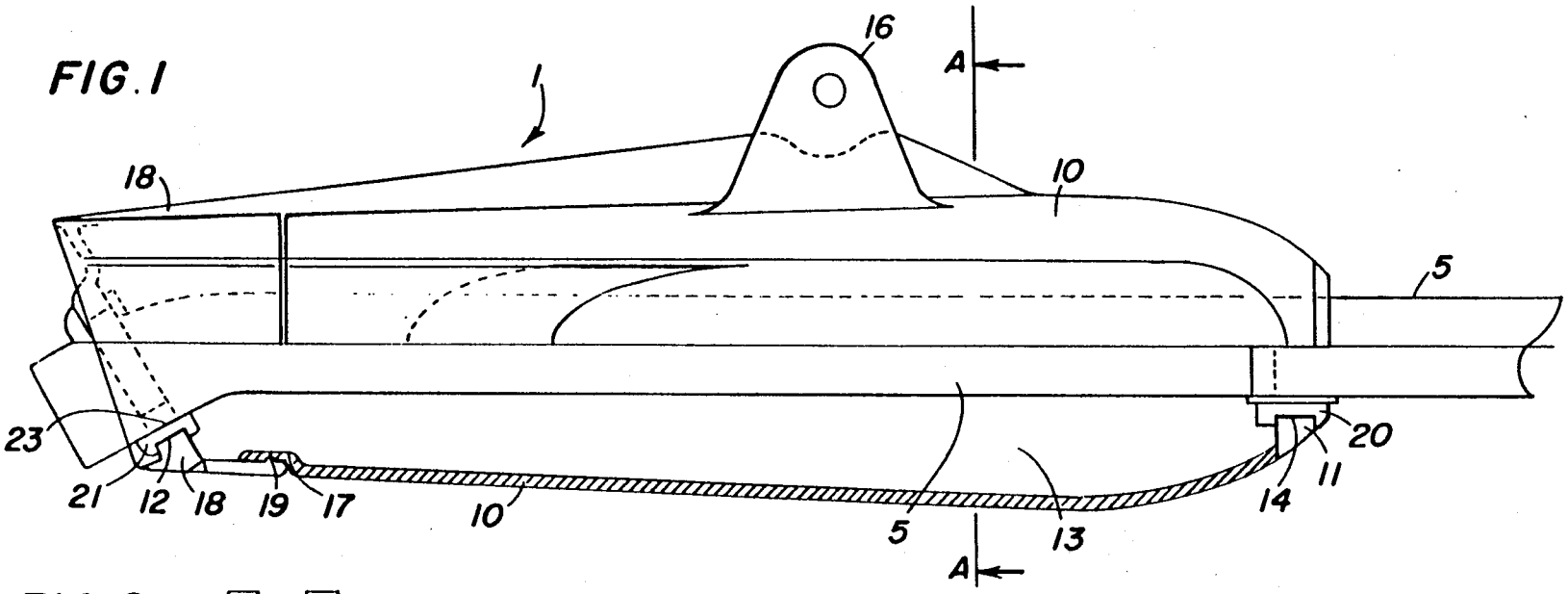
FIG. 1 is a partly sectioned front view of an absorption silencer according to the invention.
Figure 2:
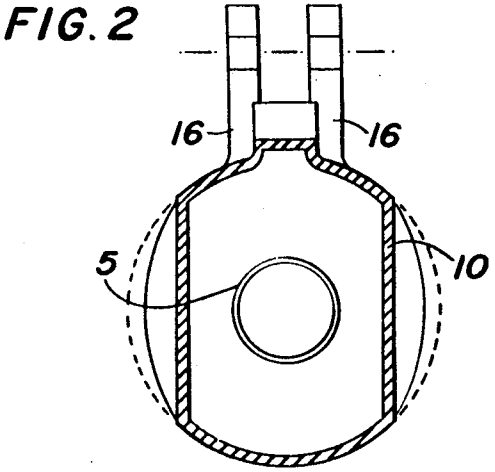
FIG. 2 is a section taken on line A-A of FIG. 1.
Figure 3:
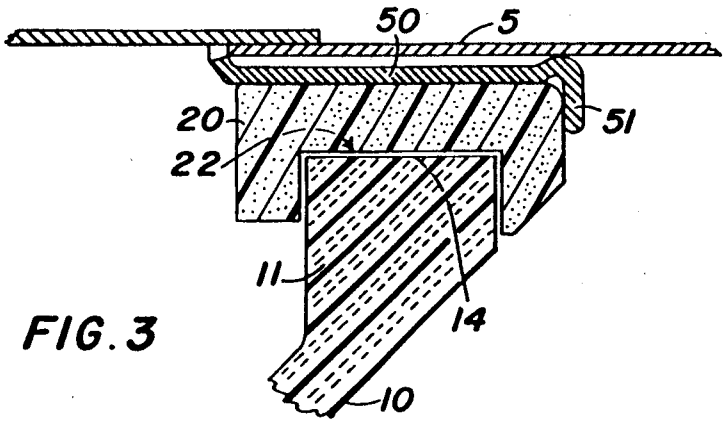
FIG. 3 is a sectional view section the detail of the connection between the housing and the silencer exhaust of FIG. 1.

Reduced to its essential structure and with reference to the attached drawings, an absorption silencer for internal-combustion engines, especially for off-road vehicles, according to the invention, comprises:

a housing 1 including a first part 10 and a second part 18 The first part 10 is formed of a substantially cylindrical shape with two upper legs 16 for the anchorage to the vehicle frame and with the front end 11 of reduced section to form an inner annular seat 14 of a diameter slightly greater than that of the exhaust pipe 5 and with the rear end 17 provided with an outer annular groove 19. The other or second part 18 is formed of substantially cylindrical shape, with the rear end provided with an inner annular seat 12 of a diameter slightly greater than that of the exhaust pipe 5 and whose front end is able to be joint fitted by elastic shrinking on the rear end 17 of the first part 10. The first and second parts 10, 18 of the housing 1 are made of heat-resisting material such as nylon or PPS by the rotary molding process.

Two annular joints 20, 21 are provided, in their outer surface, with an annular groove 22, 23 having a cross-section respectively corresponding to that of the annular seats 14 and 12, and which joints are intended to join, in a removable and partially elastic way, the housing 1 with said pipe 5 in correspondence of the two ends of housing 1. In correspondence with the front joint 20, the pipe 5 is advantageously provided with an elastic metal ring 50 with stop pawl 51 for the joint 20;

A stuffing 13 of sound deadening and heat-resisting material, such as glass or rock wool, is wrapped around the pierced exhaust pipe 5.

The mounting of this silencer on the exhaust pipe of an internal-combustion engine is carried out as follows. The first part 10 of housing 1 with relevant annular joint 20 housed in the seat 14, is fitted over the perforated pipe 5 from its rear end and is then made to slide as far as the stop 16 provided at the front end of pipe 5. After filling the first housing part 10 with rock wool or similar material, the second part, provided in advance, is assembled by fitting it over the rear end of pipe 5, and bringing it close to the first part of the housing until it joins the latter by joint coupling. To ensure the stability of the junction of the two parts of the housing there is advantageously provided at least a connecting radial screw 17.

In practice, all the construction details may vary in any equivalent way as far as the form, elements disposition, nature of used materials are concerned without nevertheless departing from the scope of the present invention.

I claim:

1. An absorbtion silencer for internal-combustion engines, comprising a perforated exhaust pipe; a heat resisting and sound deadening material wrapped around said perforated exhaust pipe; a first mountable element having a rear open end with a fitting element and a front end with an opening larger than a diameter of said exhaust pipe; a second mountable element including a front open end with a fitting element engagable with said first mountable element fitting element and a rear end with an opening larger than the diameter of said perforated exhaust pipe; a first annular joint formed of heat-resisting and partially elastic material positioned between said perforated exhaust pipe and said first mountable element front end for connecting said first mountable element relative to said exhaust pipe and sealing said front end from escape of exhaust gases; and, a second annular joint formed of heat resisting and partially elastic material positioned between said exhaust pipe and said rear end of said second mountable element for connecting said second mountable element relative to said exhaust pipe and for sealing said second mountable element with respect to said exhaust pipe for preventing escape of exhaust gases.

2. An absorbtion silencer according to claim 1, wherein each of said first annular joint and said second annular joint are formed as a single piece of silicone or viton.

3. An Absorbtion silencer according to claim 1 further comprising an elastic ring formed of metal, including a stop pawl, fixed to said exhaust pipe adjacent said front annular joint.

4. An absorber silencer according to claim 1 wherein said first mountable part and said second mountable part are formed of a substantially cylindrical shape said fitting elements are formed as butt joints.

5. An aborber silencer according to claim 4 wherein said first mountable part is provided with upper legs including means for anchorage to a vehicle frame.

6. An absorber silencer according to claim 4, wherein said first mountable part and said second mountable part are formed of synthetic heat-resisting materials including one of nylon and PTS.

7. An absorber silencer according to claim 6, wherein said first and second mounting elements formed of synthetic heat-resisting material are formed by a rotary molding process.

8. An absorbtion silencer for internal-combustion engines, comprising a perforated exhaust pipe; rock wool wrapped around said perforated exhaust pipe; a first mountable element having a rear open end for passing around said rock wool, with a fitting element and a front end with an opening larger than a diameter of said exhaust pipe; a second mountable element including a front open end, for passing around said rock wool, with a fitting element engageable with said first mountable element fitting element and a second end with an opening larger than the diameter of said perforated exhaust pipe; a first annular joint formed of heat resisting and partially elastic material positioned between said perforated exhaust pipe and said first mountable element front end for connecting said first mountable element relative to said exhaust pipe and sealing said front end from escape of exhaust gases; and, a second annular joined formed of heat resisting and partially elastic material positioned between said exhaust pipe and said rear end of said second mountable element for connecting said second mountable element relative to said exhaust pipe and for sealing said second mountable element with respect to said exhaust pipe for preventing escape of exhaust gases.

* * * * *